US011753267B2

(12) United States Patent
Valenzuela-Rivas et al.

(10) Patent No.: US 11,753,267 B2
(45) Date of Patent: Sep. 12, 2023

(54) OUTPUT TRAY FINS

(71) Applicant: Hewlett-Packard Development Company, L.P., Spring, TX (US)

(72) Inventors: Rene Octavio Valenzuela-Rivas, San Diego, CA (US); Ryan M. Smith, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 1 day.

(21) Appl. No.: 17/298,584

(22) PCT Filed: Apr. 29, 2019

(86) PCT No.: PCT/US2019/029648
§ 371 (c)(1),
(2) Date: May 30, 2021

(87) PCT Pub. No.: WO2020/222741
PCT Pub. Date: Nov. 5, 2020

(65) Prior Publication Data

US 2022/0041396 A1 Feb. 10, 2022

(51) Int. Cl.
*B65H 31/34* (2006.01)
*B41J 13/10* (2006.01)
*B65H 31/02* (2006.01)

(52) U.S. Cl.
CPC ..... *B65H 31/34* (2013.01); *B41J 13/106* (2013.01); *B65H 31/02* (2013.01); *B65H 2405/115* (2013.01); *B65H 2405/1117* (2013.01); *B65H 2405/1144* (2013.01); *B65H 2405/11151* (2013.01); *B65H 2405/1412* (2013.01)

(58) Field of Classification Search
CPC ..... B65H 31/34; B65H 2402/31; B65H 2405/11151; B65H 2405/1116; B65H 2405/11162; B65H 2405/1117; B65H 2405/114; B65H 2405/1144; B65H 2405/115; B65H 2405/1412
See application file for complete search history.

(56) References Cited

U.S. PATENT DOCUMENTS 2,265,483 A 12/1941 Hill
4,033,255 A 7/1977 Kleist et al.
5,221,951 A 6/1993 Sakamoto
(Continued)

FOREIGN PATENT DOCUMENTS

CN 104108615 A 10/2014
JP 2005-231833 A 9/2005
(Continued)

*Primary Examiner* — Prasad V Gokhale
(74) *Attorney, Agent, or Firm* — Brooks, Cameron & Huebsch, PLLC

(57) ABSTRACT

Examples of alignment fins for output trays of media dispensing devices are disclosed. In an example, an alignment fin is coupled to a support surface of an output tray of a media dispensing device. The alignment fin is to transition between a first position wherein the alignment fin is disposed below the support surface, and a second position wherein the alignment fin is exposed through an aperture in the support surface. When the alignment fin is in the second position, the alignment fin is to align the media dispensed from the dispensing device into a stack on the support surface.

18 Claims, 6 Drawing Sheets

(56) References Cited

U.S. PATENT DOCUMENTS

| | | | | |
|---|---|---|---|---|
| 5,299,875 | A | 4/1994 | Hock et al. | |
| 5,775,684 | A | 7/1998 | Jackson et al. | |
| 6,009,302 | A | 12/1999 | Worley et al. | |
| 6,012,714 | A | 1/2000 | Worley et al. | |
| 6,827,510 | B2 | 12/2004 | Hayashi | |
| 8,842,148 | B2 | 9/2014 | Fukuma | |
| 9,662,906 | B2 | 5/2017 | Kobayashi | |
| 10,087,031 | B2 * | 10/2018 | Otsuka | B65H 31/20 |
| 2002/0017754 | A1 * | 2/2002 | Kang | B41J 11/0055 271/223 |
| 2008/0310899 | A1 * | 12/2008 | Yoo | G03G 15/6552 399/397 |
| 2014/0321877 | A1 * | 10/2014 | Ono | G03G 21/206 399/92 |
| 2021/0101768 | A1 * | 4/2021 | Mizuguchi | B65H 31/02 |

FOREIGN PATENT DOCUMENTS

| | | | |
|---|---|---|---|
| JP | 3819628 | B2 | 9/2006 |
| JP | 5171462 | B2 | 3/2013 |

* cited by examiner

OUTPUT TRAY FINS

BACKGROUND

Media scanning devices may automatically feed, scan, and dispense a stack of media. Upon dispensing the media, the media scanning device may deposit the scanned media into a stack on an output tray for subsequent retrieval by a user.

BRIEF DESCRIPTION OF THE DRAWINGS

Various examples will be described below referring to the following figures.

DETAILED DESCRIPTION

Figure 1:
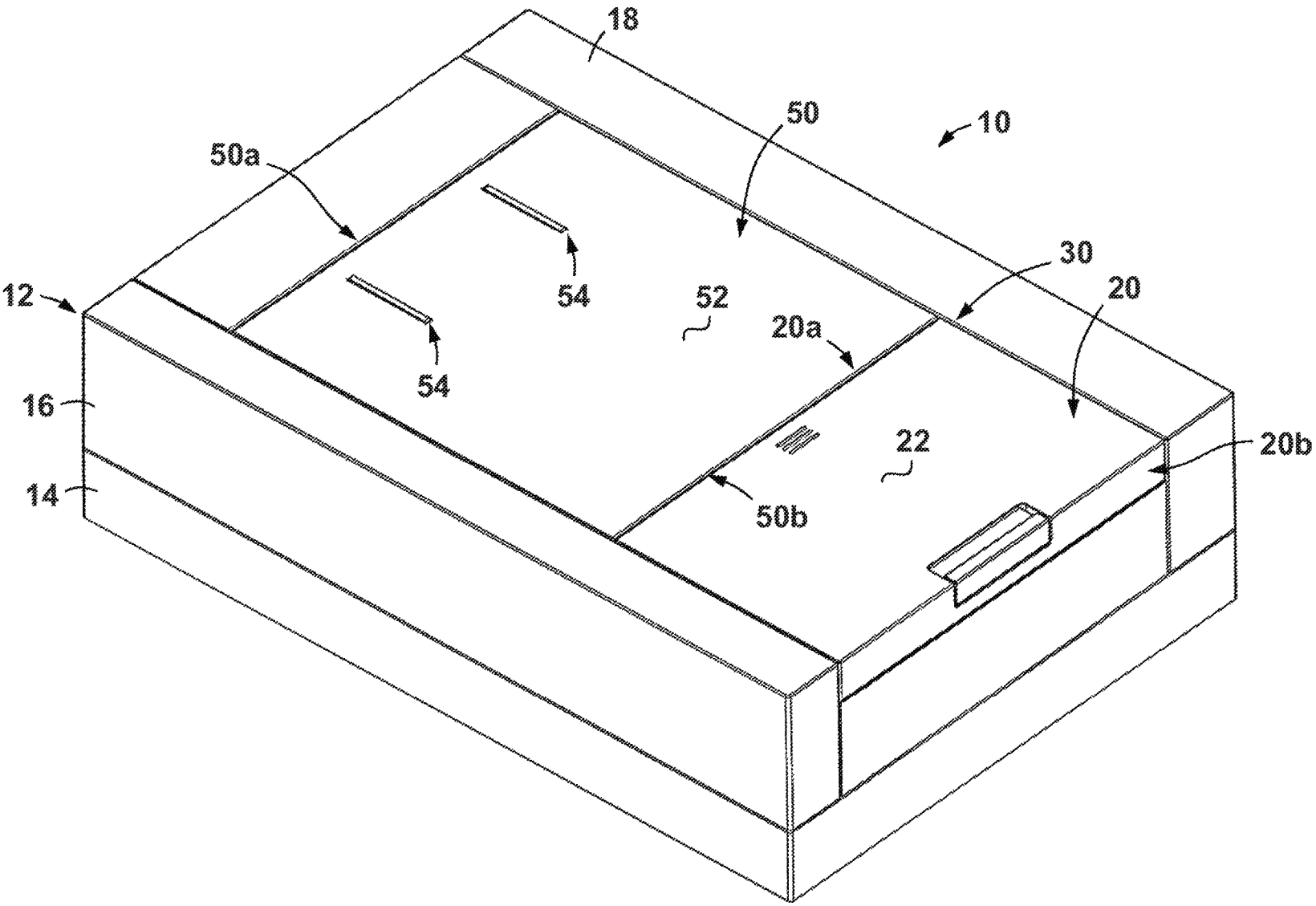
FIG. 1 is a perspective view of a media scanning device according to some examples.

In the figures, certain features and components disclosed herein may be shown exaggerated in scale or in somewhat schematic form, and some details of certain elements may not be shown in the interest of clarity and conciseness. In some of the figures, in order to improve clarity and conciseness, a component or an aspect of a component may be omitted.

In the following discussion and in the claims, the terms "including" and "comprising" are used in an open-ended fashion, and thus should be interpreted to mean "including, but not limited to . . . ." Also, the term "couple" or "couples" is intended to be broad enough to encompass both indirect and direct connections. Thus, if a first device couples to a second device, that connection may be through a direct connection or through an indirect connection via other devices, components, and connections. In addition, as used herein, the terms "axial" and "axially" generally refer to positions along or parallel to a central or longitudinal axis (e.g., central axis of a body or a port), while the terms "lateral" and "laterally" generally refer to positions located or spaced to the side of the central or longitudinal axis.

As used herein, including in the claims, the word "or" is used in an inclusive manner. For example, "A or B" means any of the following: "A" alone, "B" alone, or both "A" and "B." In addition, when used herein including the claims, the word "generally" or "substantially" means within a range of plus or minus 10% of the stated value. As used herein, the terms "downstream" and "upstream" are used to refer to the arrangement of components and features within a printer or scanning device with respect to the "flow" of media through the printer or scanning device during operations. Thus, if a first component of such a device receives media after it is output from a second component of the device during operations, then the first component may be said to be "downstream" of the second component and the second component may be said to be "upstream" of the first component.

As previously described above, media scanning devices may dispense scanned media (e.g., documents, images, etc.) into a stack on an output tray, so that the media may then be retrieved by a user. Such output trays may include an alignment fin (or a pair of alignment fins) to guide and align the dispensed media into a single aligned stack. However, in some circumstances, the alignment fin(s) may extend outside of a general profile of the media scanning device and are therefore more likely to be damaged (e.g., such as when the media scanning device is moved or when people or equipment are maneuvering around the media scanning device). In addition, the alignment fin(s) may detract from an otherwise sleek or smooth appearance of the media scanning device when the media scanning assembly is not in use. Accordingly, examples disclosed herein include output trays for media scanning devices (as well as media scanning devices incorporating such output trays) that include a deployable alignment fin (or a plurality of deployable alignment fins) that may be selectively deployed above the support surface of the output tray during scanning and media dispensing operations.

While specific examples disclosed include alignment fins on an output tray of a media scanning device, it should be appreciated that the disclosed alignment fins (and associated output trays) may also be utilized on other media dispensing devices in other examples. For instance, in some examples, the alignment fins discussed herein may be included on a printer, copier, or other device that is to dispense media onto an output tray. Thus, discussion of a media scanning device is not meant to limit all potential uses of the disclosed alignment fins.

Figure 2:
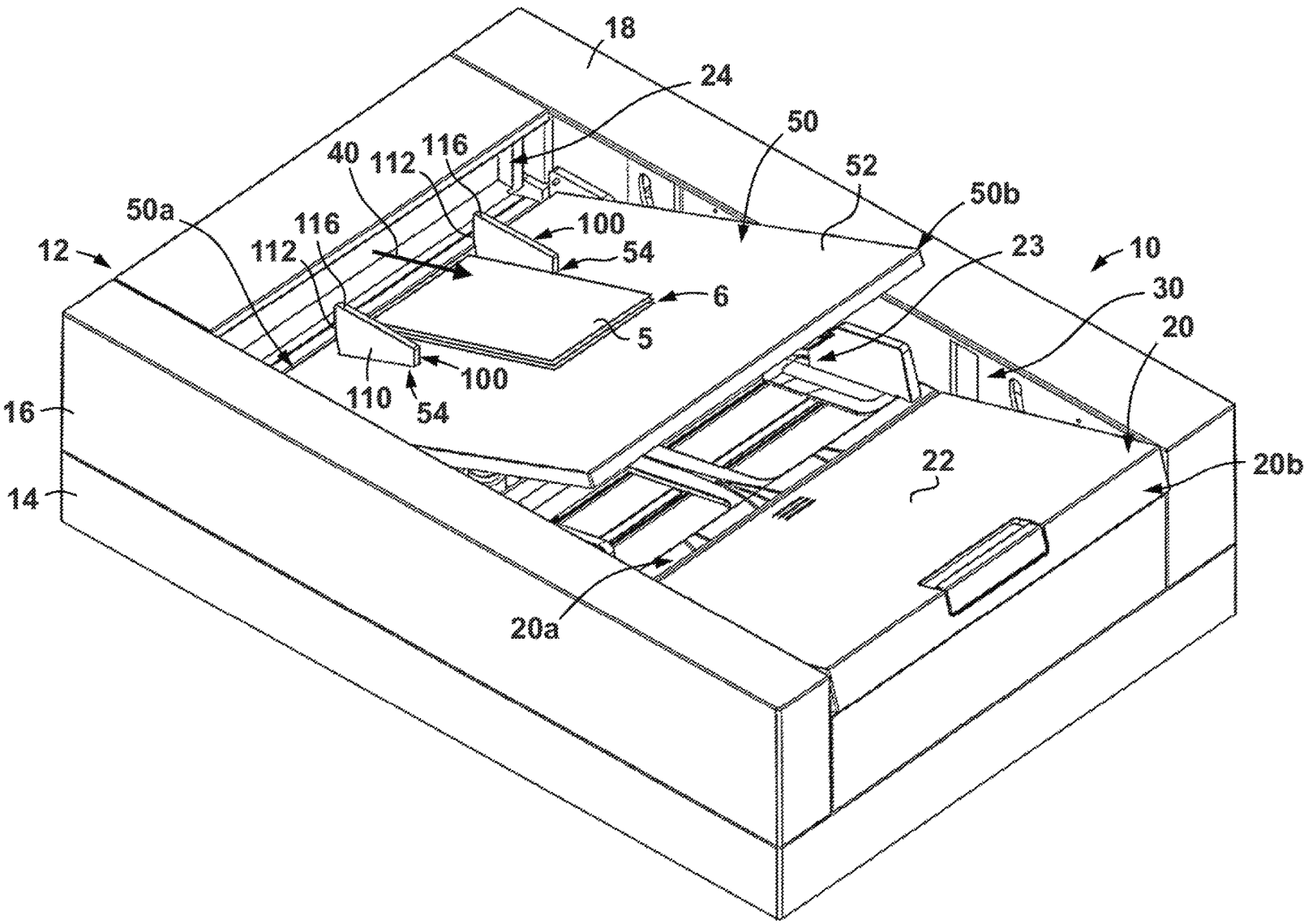
FIG. 2 is another perspective view of the media scanning device of FIG. 1 according to some examples.

Referring now to FIGS. 1 and 2, a media dispensing device 10 is shown. In this example, media dispensing device 10 is a scanning device, and thus, device 10 may be referred to herein as a "media scanning device" 10. Media scanning device 10 may be a standalone device, or may be mounted or incorporated into another device (e.g., a printer or copier device). Generally speaking, media scanning device 10 comprises a housing 12 including a first or lower housing 14 and a second or upper housing 16 disposed atop the lower housing 14. In this example, lower housing 14 supports a flat-bed scanning assembly (not shown) whereby a user may place a piece of media (e.g., document, photo, etc.) on a transparent platen (e.g., a pane of glass) for scanning (or copying). Thus, in this example, upper housing 16 is rotatably coupled to lower housing 14 so that a user may rotate upper housing 16 relative to lower housing 14 to expose the flat-bed scanning assembly (not shown) when desired.

Upper housing 16 supports an automatic document feeding assembly 30 that includes an input tray 20 and an output tray 50. Input tray 20 includes a first end 20*a*, a second end 20*b* opposite first end 20*a*, and a planar support surface 22 extending between ends 20*a*, 20*b*. Output tray 50 includes a first end 50*a*, a second end 50*b* opposite first end 50*a*, and a planar support surface 52 extending between ends 50*a*, 50*b*. Support surfaces 22, 52 are to support media 5 when it is disposed within the corresponding trays 20, 50. In particular, media 5 disposed or inserted within input tray 20 is supported by support surface 22, and media 5 disposed or dispensed into output tray 50 is supported by support surface 52.

As shown in the sequence of FIG. 1 to FIG. 2, in this example, both input tray 20 and output tray 50 are deployable or transitionable between a closed position (FIG. 1) and an open position (FIG. 2). When input tray 20 and output tray 50 are in the closed positions shown in FIG. 1, the support surfaces 22, 52 are substantially flush or co-planar with a top planar surface 18 of upper housing 16. Conversely, when input tray 20 is in the open position of FIG. 2, the support surface 22 is disposed at a non-zero angle to top planar surface 18 and an opening or inlet port 23 into media scanning device 10 is exposed. Similarly, when output tray 50 is in the open position of FIG. 2, the support surface 52 is disposed at a non-zero angle to top planar surface 18 (which may be the same or different from the non-zero angle formed between support surface 22 and top planar surface 18 previously described above), and an output port 24 from media scanning device 10 is exposed.

Figure 3:
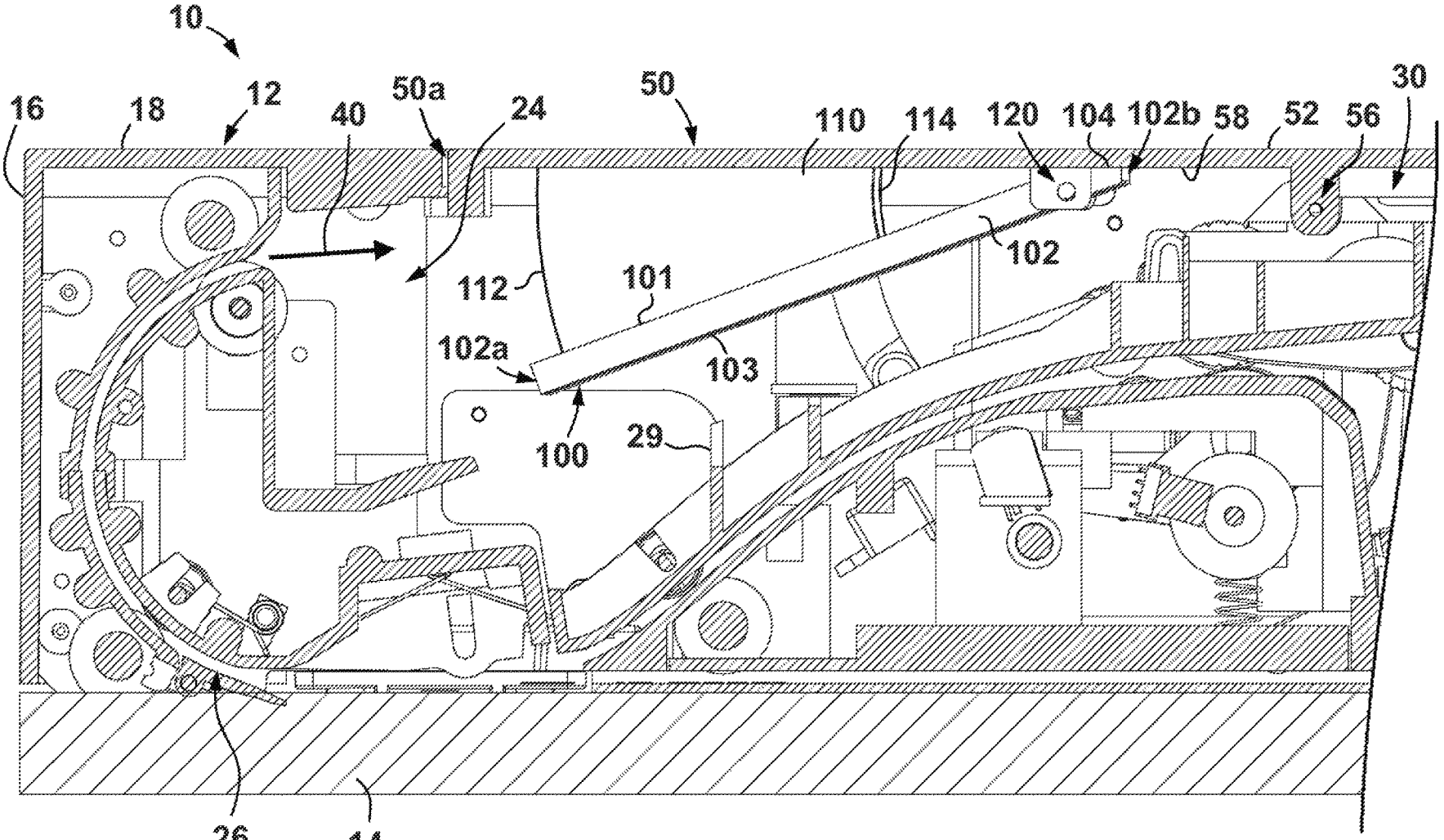
FIG. 3 is a side cross-sectional view of the media scanning device of FIG. 1 according to some examples.
Figure 4:
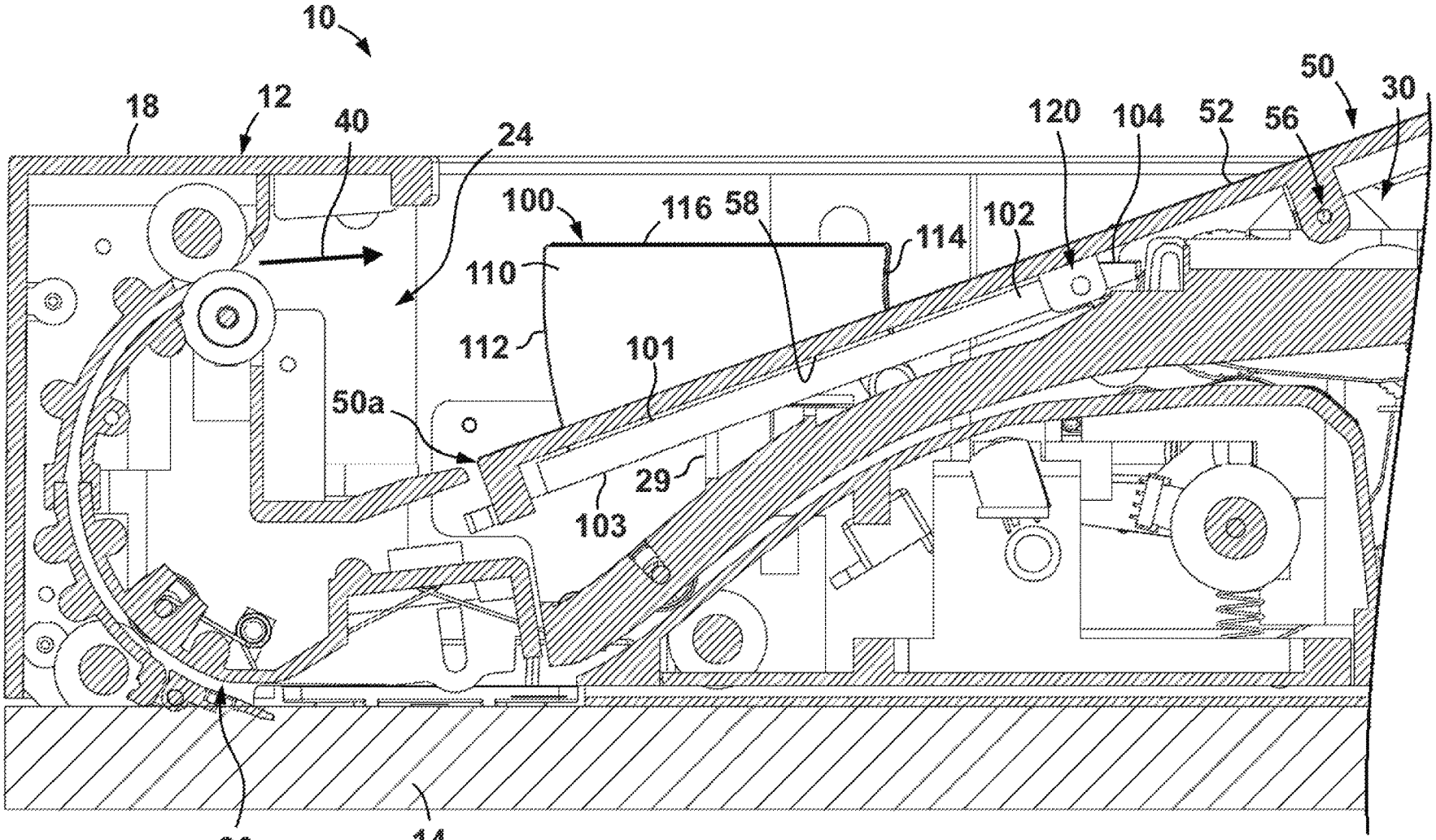
FIG. 4 is another side cross-sectional view of the media scanning device of FIG. 1 according to some examples.
Figure 5:
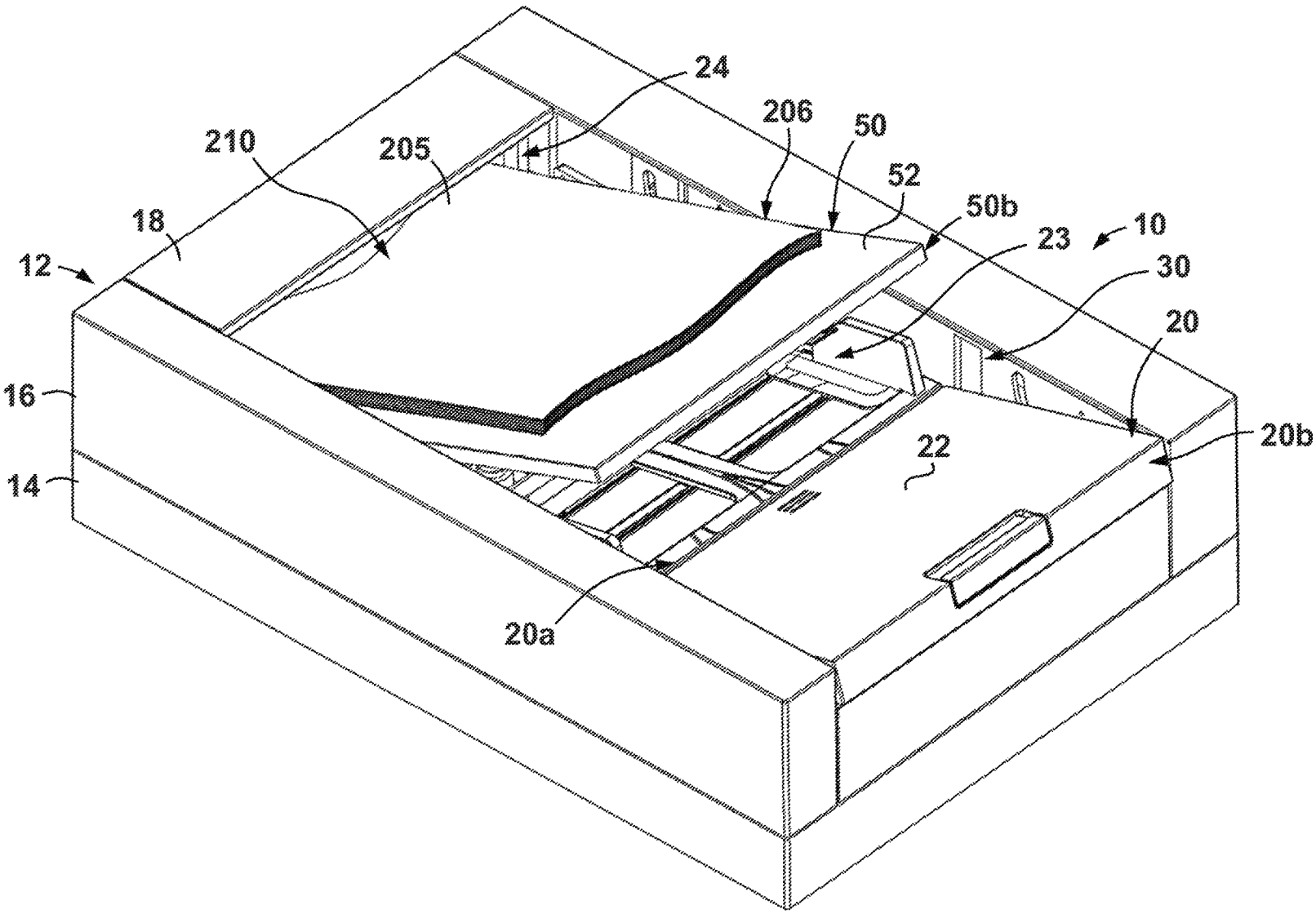
FIG. 5 is a perspective view of the media scanning assembly of FIG. 1 with relatively wide media dispensed into the output tray according to some examples.

In this example, when transitioning the input tray 20 from the closed position of FIG. 1 to the open position of FIG. 2, the input tray 20 is rotated relative to upper housing 16 so that first end 20*a* of input tray 20 pivots or rotates downward from top planar surface 18. Similarly, when transitioning the output tray 50 from the closed position of FIG. 1 to the open position of FIG. 2, the output tray 50 is rotated relative to upper housing 16 so that first end 50*a* of tray 50 pivots or rotates downward from top planar surface 18 and second end 50*b* pivots or rotates upward form top planar surface 18. Referring briefly to FIGS. 3 and 4, output tray 50 is pivotably coupled to upper housing 16 at a pinned connection 56 that is disposed between first end 50*a* and second end 50*b* (see FIGS. 1 and 2). Thus, when output tray 50 is transitioned between the closed position (see e.g., FIG. 3) and the open position (see e.g., FIG. 4), output tray 50 is pivoted relative to upper housing 16 at pinned connection 56.

Referring again to FIGS. 1 and 2, during operations, a user may transition the input tray 20 and the output tray 50 from the closed position (FIG. 1) to the open position (FIG. 2) to expose the inlet port 23 and outlet port 24. Thereafter, the user may place media 5 onto support surface 22 of input tray 20 and initiate a media scanning operation either by manipulating a user interface mounted or coupled to the media scanning device 10 or by interacting with a separate computing device (e.g., a desk top computer, lap top computer, smartphone, tablet, etc.) that is communicatively coupled to media scanning device 10. Upon initiation of a media scanning operation, the media 5 is drawn into the input port 23 via a roller (or plurality of rollers) and advanced along a media path (not shown in FIGS. 1 and 2 but see generally numeral 26 in FIGS. 3 and 4), where a front and/or a back side of the media 5 is scanned by suitable scanning devices. Eventually, the media 5 is dispensed from the media scanning device 10 via output port 24 along a dispensing direction 40 (or more simply "direction 40") onto support surface 52 of output tray 50, so that the user may retrieve the scanned media.

During these operations, as media 5 is dispensed from output port 24 along direction 40, alignment fins 100 may engage with the media 5 so as to align the media into a stack 6 on support surface 52. In the example of FIG. 2, the media 5 is sized so as to form a stack 6 that is disposed between fins 100. In particular, media 5 has a width that is smaller than the spacing or separation between fins 100 along support surface 52. As will be described in more detail below, some media may have a width that is larger than the spacing between fins 100, and for such media, engagement with fins 100 may still align the media within a stack on support surface 52.

When output tray 50 is in the closed position of FIG. 1, alignment fins 100 are disposed in a first or withdrawn position wherein the alignment fins 100 are disposed below the support surface 52 (as used herein, the term "below" in this context includes situations where the alignment fins 100 are flush or co-planar with the support surface 52). However, when output tray 50 is transitioned to the open position of FIG. 2 (e.g., during a media scanning operation as describe above), alignment fins 100 are transitioned to a second or deployed position whereby the alignment fins 100 extend upward through apertures 54 in support surface 52 so as to align the media 5 dispensed from output port 24 into stack 6 as previously described above.

Referring now to FIGS. 3 and 4, each alignment fin 100 includes a base 102 and a body 110 extending from base 102. Base 102 has a first end 102*a* and a second end 102*b* opposite first end 102*a*. In addition, base 102 includes a top surface 101 disposed between ends 102*a*, 102*b*, and a bottom surface 103 also disposed between ends 102*a*, 102*b*. In some examples (e.g., such as in FIGS. 3 and 4) top surface 101 and bottom surface 103 are planar surfaces; however, surfaces 101, 103 (or portions thereof) may be nonplanar in other examples. Further, base 102 includes an angled or chamfered surface 104 that extends from top surface 101 to second end 102*b*. Thus, top surface 101 extends from first end 102*a* to chamfered surface 104 (which further extends from top surface 101 to second end 102*b* as previously described), and bottom surface 103 extends from first end 102*a* to second end 102*b*. In this example, chamfered surface 104 is a planar surface that extends at a non-zero angle to top surface 101. For instance, chamfered surface 104 may extend at an angle greater than 0° and less than 90° relative to top surface 101.

In addition, base 102 is pivotably coupled to output tray 50 at a pinned connection 120 that is disposed between ends 102*a*, 102*b*. In this example, pinned connection 120 is proximate second end 102*b* and distal first end 102*a* of base 102. In addition, base 102 is pivotably coupled to output tray 50 such that first end 102*a* of base 102 is more proximate first end 50*a* of output tray 50 than second end 102*b*.

Body 110 of each alignment fin 100 extends from the top surface 101 of the corresponding base 102 and includes a top edge 116 and a pair of arcuate or curved sides 112, 114, that extend between top edge 116 and base 102 (more particularly top surface 101). In particular, one side 112 of body 110 is more proximal to first end 102*a* of base 102 than second end 102*b* and the other side 114 of body 110 is more proximal second end 102*b* of base 102 than first end 102*a*.

Referring specifically to FIG. 3, when output tray 50 is in the closed position, the alignment fins 100 are in the withdrawn position as previously described above (see also FIG. 1). In particular, when alignment fins 100 are disposed in the withdrawn position, alignment fins 100 are pivoted downward from support surface 52 about pinned connection 56 under the force of gravity. In some examples, a biasing member (e.g., a torsional spring) may be coupled to pinned connections 120 so as to rotationally bias alignment fins 100 about the corresponding pinned connections 120 during operations (e.g., fins 100 may be rotationally biased toward the withdrawn positions). The pivotable range of motion of alignment fins 100 about pinned connection 120 is limited in the downward direction due to engagement between the chamfered surface 104 on base 102 of each alignment fin 100 and a lower surface 58 of the output tray 50. In this example, the angle of chamfered surface 104, as well as the size and shape of body 110, allow the top edge 116 of each alignment fin 100 to be disposed at or below support surface 52 of output tray 50 when chamfered surface 104 is engaged with lower surface 58 as shown in FIG. 3. In some examples, body 110 is retained within apertures 54 when alignment fins 100 are in the withdrawn position. In other examples, body 110 is totally withdrawn from apertures 54 when alignment fins 100 are in the withdrawn position.

Referring again to FIGS. 3 and 4, as output tray 50 is transitioned from the closed position (FIG. 3) to the open position (FIG. 4), first end 50*a* is pivoted downward and away from top planar surface 18 about pinned connection 56 as previously described. Simultaneously, alignment fins 100 are initially carried along with output tray 50 as it pivots about pinned connection 56 until alignment fins 100 engage or abut with an engagement member 29 defined within upper housing 16. Thereafter, continued rotation of output tray 50 about pinned connection 56 further causes alignment fins 100 to pivot about their respective pinned connections 120 relative to output tray 50 such that the body 110 of each alignment fin 100 is extended through the corresponding apertures 54 in support surface 52. The downward rotation of first end 50*a* of output tray 50 continues until lower surface 58 of output tray 50 engages with the base 102 of each alignment fin 100. Because base 102 of each alignment fin 100 is engaged with engagement member 29 within upper housing 16 as previously described, further rotation of output tray 50 is prevented upon engagement of lower surface 58 and bases 102 as shown in FIG. 4. Additionally, the engagement between lower surface 58 of output tray 50 and bases 102 of alignment fins 100 also corresponds with the maximum extension of bodies 110 through apertures 54 in support surface 52. As a result, when output tray 50 reaches the fully open position in FIG. 4, alignment fins 100 simultaneously reach their fully deployed positions through apertures 54 in support surface 52 (see also FIG. 2).

Referring still to FIGS. 3 and 4, as output tray 50 is transitioned from the open position (FIG. 4) to the closed position (FIG. 3), first end 50*a* is pivoted upward toward top planar surface 18 of upper housing 16 as previously described. Initially, alignment fins 100 remain engaged with engagement member 29 such that as output tray 50 initially pivots from the open position of FIG. 4 toward the closed position of FIG. 3, alignment fins 100 also pivot about their corresponding pinned connections 120 with output tray 50 to withdraw bodies 110 into apertures 54 in support surface 52. The withdrawal of bodies 110 of alignment fins 100 continues as first end 50*a* of output tray 50 rotates upward toward top planar surface 18 until chamfered surfaces 104 on bases 102 engage with lower surface 58 of output tray 50. Thereafter, continued rotation of first end 50*a* of output tray 50 about pinned connection 56 toward top planar surface 18 also causes a simultaneous rotation of alignment fins 100 (now withdrawn below support surface 52 within apertures 54) along with output tray 50. This simultaneous rotation of output tray 50 and alignment fins 100 continues until output tray 50 reaches the fully closed position shown in FIG. 3. As a result, when output tray 50 reaches the closed position of FIG. 3, the alignment fins 100 are disposed in their withdrawn positions as previously described above (see also FIG. 1).

Figure 6:
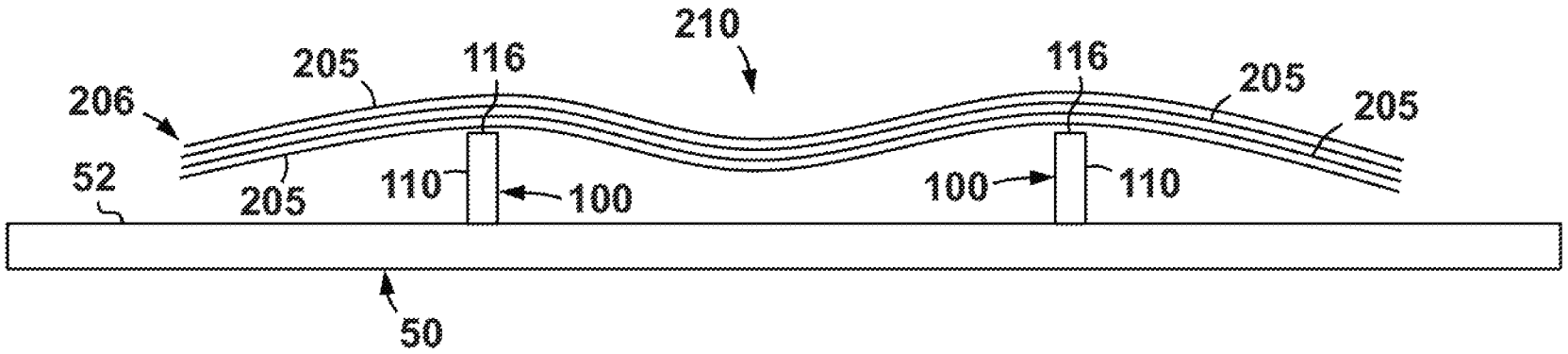
FIG. 6 is a schematic front view of the output tray of the media scanning assembly of FIG. 5 according to some examples.

Referring now to FIGS. 6 and 7, as previously described above, in some examples, relatively wide media may be scanned by media scanning device 10 and therefore dispensed onto support surface 52 of output tray 50. Specifically, in the example of FIGS. 6 and 7, pieces of media 205 are dispensed from output port 24 onto support surface 52 that have a width that is larger than the spacing between alignment fins 100 (which are in the deployed position previously described above—see e.g., FIGS. 2 and 4). As media 205 is dispensed onto output tray 50, it engages with alignment fins 100, particularly with top edge 116 of bodies 110 so that the force of gravity forms a depression or dip 210 in a central region of the media 205 between alignment fins 100 (note: FIG. 7 only shows bodies 110 of fins 100 in order to simplify the figure). The depression 210 aligns the dispensed media 205 into a stack 206 that may be generally centered between alignment fins 100. It should be noted that FIG. 7 schematically shows the engagement between alignment fins 100 and media 205. Thus, while FIG. 7 shows a portion of the media 205 that is suspended above support surface 52 by alignment fins 100, it should be appreciated (e.g., such as by the view depicted in FIG. 6) that other portions of media 205 (e.g., the portions of media 205 that are more proximate second end 50*b* of output tray 50) may still engage with support surface 52. Thus, alignment fins 100 may align the media into a stack (e.g., stack 206) on support surface 52, even within examples where larger or wider media (e.g., media 205) is dispensed on to output tray 50.

Examples disclosed herein have included output trays for media scanning devices (as well as media scanning device incorporating such output trays) that include a deployable alignment fin (or a plurality of deployable alignment fins) (e.g., fins 100) that may be selectively deployed above the support surface of the output tray during scanning and media dispensing operations. Accordingly, the alignment fins may be selectively withdrawn relative to the output tray support surface so that the output tray may exhibit a smooth surface, and so that the risk of damage to the alignment fins may be reduced.

The above discussion is meant to be illustrative of the principles and various examples of the present disclosure. Numerous variations and modifications will become apparent to those skilled in the art once the above disclosure is fully appreciated. It is intended that the following claims be interpreted to embrace all such variations and modifications.

What is claimed is:

1. An output tray for a media dispensing device, the output tray comprising:
- a support surface to support media dispensed from the media dispensing device; and
- an alignment fin coupled to the support surface;
- wherein the support surface is to transition between:
  - a closed position wherein the support surface is coplanar with a housing of the media dispensing device and the alignment fin is disposed below the support surface; and
  - an open position wherein the alignment fin is exposed through an aperture in the support surface;
  - wherein as the support surface is transitioned from the closed position toward the open position, the alignment fin is to:
    - extend through the aperture in the support surface; and
    - align the media dispensed from the media dispensing device into a stack on the support surface.

2. The output tray of claim 1, wherein the alignment fin is pivotably coupled to the support surface at a first pinned connection, and wherein the alignment fin is to rotate about the first pinned connection to transition between a first position and a second position.

3. The output tray of claim 2, wherein the support surface is rotatable between the closed position wherein the support surface is to occlude an output port of the media dispensing device, and the open position wherein the support surface is to receive the media dispensed from the output port.

4. The output tray of claim 3, wherein the alignment fin is to transition from the first position to the second position while the support surface is transitioned from the closed position to the open position.

5. The output tray of claim 4, wherein the alignment fin comprises:

a base; and a body extending from the base;

wherein the first pinned connection is disposed on the base of the alignment fin; and wherein the body is to extend through the aperture in the support surface while the alignment fin is transitioned to the second position.

6. The output tray of claim 5, wherein the body includes a top edge and a pair of curved sides extending from the base to the top edge.

7. The output tray of claim 2, wherein the support surface is rotatable relative to the housing of the media dispensing device so that a first end of the support surface rotates downward from a top planar surface of the housing and a second end, opposite the first end, rotates upward from the top planar surface of the housing.

8. The output tray of claim 2, wherein while the support surface is transitioned between the closed position and the open position, the support surface rotates relative to the housing at a second pinned connection.

9. The output tray of claim 1, wherein the aperture is an opening in the support surface and while the support surface is in the closed position the alignment fins are disposed below the support surface.

10. A media dispensing device, comprising:

an output port to dispense media therefrom;

an output tray comprising a support surface to receive the media dispensed from the output port; and an alignment fin coupled to the support surface, wherein the support surface is to transition between:

a closed position wherein the support surface is co-planar with a housing of the media dispensing device and the alignment fin is disposed below the support surface; and an open position wherein the alignment fin is exposed through an aperture in the support surface;

wherein as the support surface is transitioned from the closed position toward the open position, the alignment fin is to:

extend through the aperture in the support surface; and align the media dispensed from the output port into a stack on the support surface.

11. The media dispensing device of claim 10, wherein the output tray is rotatable between the closed position wherein the support surface is to occlude the output port, and the open position wherein the support surface is to receive the media dispensed from the output port.

12. The media dispensing device of claim 11, wherein the alignment fin is to transition from a first position to a second position while the output tray is transitioned from the closed position to the open position.

13. The media dispensing device of claim 11, wherein the alignment fin is pivotably coupled to the output tray and wherein the alignment fin is to rotate relative to the output tray to transition between a first position and a second position.

14. The media dispensing device of claim 10, wherein the alignment fin comprises:

a base; and a body extending from the base;

wherein the base is pivotably coupled to the output tray; and wherein the body is to extend through the aperture in the support surface and the base is to engage a first position of a lower surface of the output tray while the alignment fin is transitioned from a first position to a second position.

15. The media dispensing device of claim 14, wherein the base comprises a first end, a second end, a top surface, a bottom surface, and a chamfered surface;

wherein the bottom surface extends from the first end to the second end;

wherein the top surface extends from the first end to the chamfered surface, and the chamfered surface extends from the top surface to the second end; and wherein the chamfered surface is to engage with a second position of the lower surface of the output tray while the alignment fin is in the first position.

16. A media dispensing device, comprising:

an output port to dispense media therefrom;

an output tray comprising a support surface to receive the media dispensed from the output port, wherein the output tray is rotatable between:

a closed position wherein the support surface is co-planar with a housing of the media dispensing device and is to occlude the output port; and an open position wherein the support surface is to receive the media dispensed from the output port; and a first alignment fin pivotably coupled to the output tray, wherein the first alignment fin is to rotate relative to the output tray to transition between:

a withdrawn position wherein the first alignment fin is disposed below the support surface; and a deployed position wherein the first alignment fin is exposed and extended through a first aperture in the support surface;

wherein rotation of the output tray from the closed position to the open position transitions the first alignment fin from the withdrawn position below the support surface to the deployed position extended through the first aperture in the support surface; and wherein while the first alignment fin is in the deployed position, the first alignment fin is to align the media dispensed from the output port into a stack on the support surface.

17. The media dispensing device of claim 16, comprising:

a second alignment fin pivotably coupled to the output tray, wherein the second alignment fin is to rotate relative to the output tray to transition between:

a withdrawn position wherein the second alignment fin is disposed below the support surface; and a deployed position wherein the second alignment fin is exposed and extended through a second an aperture in the support surface;

wherein rotation of the output tray from the closed position to the open position transitions the second alignment fin from the withdrawn position below the support surface to the deployed position extended through the second aperture in the support surface; and wherein while the first and second alignment fins are in the deployed position, the first and second alignment fin are to align the media dispensed from the output port into the stack on the support surface.

18. The media dispensing device of claim 17, wherein both the first alignment fin and the second alignment fin comprise a base and a body extending from the base, wherein the base of the first alignment fin and the base of the second alignment fin are to engage with a lower surface of the output tray when the first and second alignment fins are transitioned to the deployed position.

* * * * *